United States Patent [19]

Haskelson

[11] Patent Number: 4,909,543

[45] Date of Patent: Mar. 20, 1990

[54] GRID PATTERNED FILE FOLDERS

[75] Inventor: Pierre Haskelson, Huntington, N.Y.

[73] Assignee: Esselte Pendaflex Corporation, Garden City, N.Y.

[21] Appl. No.: 258,564

[22] Filed: Oct. 17, 1988

[51] Int. Cl.[4] ..... B42D 15/00

[52] U.S. Cl. ..... 283/117; 281/2; 281/5; 281/51

[58] Field of Search ..... 283/117, 62; 281/2, 281/5, 51

[56] References Cited

U.S. PATENT DOCUMENTS 2,226,855 12/1940 Goldwyn ..... 283/117 X 4,445,711 5/1984 Cunningham ..... 283/117

*Primary Examiner*—Paul A. Bell

*Attorney, Agent, or Firm*—Darby & Darby

[57] ABSTRACT

A paper file folder has a repeating inked grid pattern. Each element of the pattern has printed lines surrounding an uninked background. The folder is used as an office product to provide decoration, a means for neat uniform labelling and a surface for optimal glue adhesion.

12 Claims, 1 Drawing Sheet

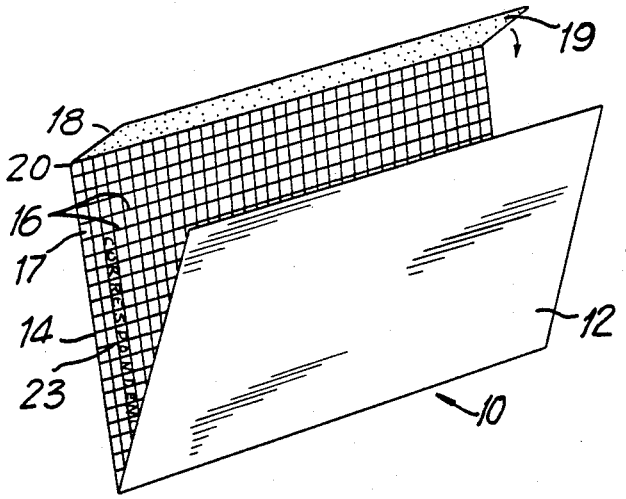
FIG. 1
FIG. 2
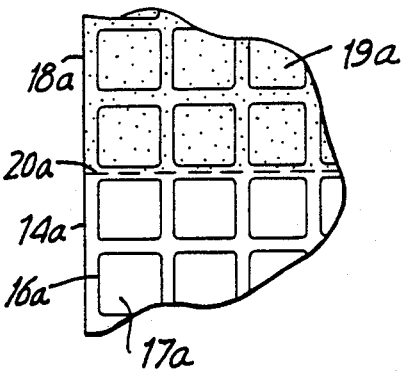
FIG. 3
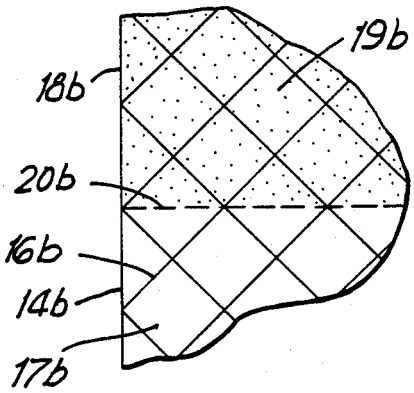
FIG. 4
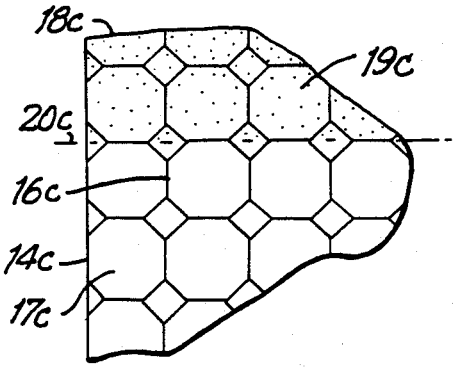
FIG. 5
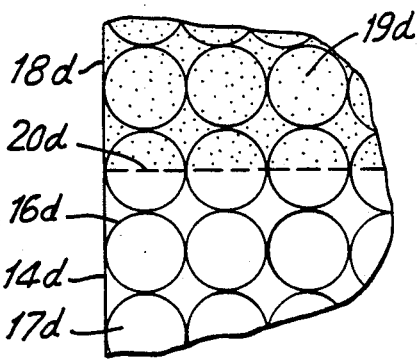

GRID PATTERNED FILE FOLDERS

TECHNICAL FIELD

The present invention relates to paper office supplies and, in particular, to paper folders having a decorative grid pattern design which serves as a means for labelling the folders and for increasing the strength of the glued seams of the folders.

BACKGROUND ART

"File folders", referred to herein include file folders, portfolios, hanging folders, pocket folders, accordion folders, reinforced folders, report covers, etc. Such folders are a necessary tool in the modern office or business. These products are also often used in homes and schools. Typically, such folders are manufactured in a wide range of colors, and may include pictures or written matter.

It is often desirable or necessary for the purchaser to label such products to customize them for a particular use. Since these folders are typically unlined, such labelling tends to be messy or is placed inconsistently from file to file, cutting down on efficiency, especially in office or business use, where uniformity of labelling may be crucial.

Additionally, for all uses, strength and durability of the paper product, especially glued seams, is important. Longer lasting products need to be replaced less often, and therefore, save the user time and money.

The optimal gluing surface is uninked because such surfaces leave rough fibers which promote adhesion, especially to another uninked surface, with the glue ordinarily used for this purpose. Uninked folders, however, are generally not as aesthetically pleasing to most users as those with color or designs. The difficulty is that ink tends to flatten and smooth the paper fibers on a surface, making gluing more difficult and adhesion less strong, unless an expensive, especially formulated glue is used.

Thus, there is a need for decorative, inexpensively producible folders which have strong glue seams and a means for neat uniform labelling of the folders for use in the office and business community, as well as in schools and in the home.

SUMMARY OF THE PRESENT INVENTION

The present invention is directed to folders having a grid pattern design giving three advantages to the user. First, the grid is highly attractive and decorative, and can be made available in a wide range of color combinations. Second, the grid provides a means for neat uniform labelling of the folders, as is often necessary for office or business use. Third, the uninked white background of the grid has fibers unflattened by ink, which provides an optimal surface for durable and strong adhesion with the inexpensive glue normally used for such products.

In an illustrative embodiment of the invention a file folder is formed which has at least a portion of its surface covered with a regularly repeating geometric pattern. This pattern is characterized by inked lines, e.g. in the form of squares or circles, which leave a large amount of uninked area or white space. The individual elements of the pattern, e.g. the squares or circles, have a size such that a readily legible handwritten alphanumeric character can be entered on the white space within the inked lines of the element.

In a preferred embodiment, the parts of the folder which are glued together, e.g. flaps or tabs, are covered with the pattern at the same time that the rest of the surface area is printed. The pattern is designed so that it has sufficient white space to allow the parts to be glued together by ordinary glue that would be unsuitable for a completely inked surface.

BRIEF DESCRIPTION OF THE DRAWINGS

The foregoing and other features of the present invention will be more readily apparent from the following detailed description and drawings of an illustrative embodiment of the invention in which:

FIG. 1 shows a perspective view of a file folder prior to completion, which folder has a repeating square grid pattern according to the present invention;

FIG. 2 shows the grid pattern of the present invention with a rounded edge square pattern;

FIG. 3 shows the grid pattern of the present invention with a diamond pattern;

FIG. 4 shows the grid pattern of the present invention with a hexagon pattern; and FIG. 5 shows the grid pattern of the present invention with a circular pattern.

DESCRIPTION OF THE PREFERRED EMBODIMENTS

As shown in FIG. 1, a folder 10 having a first side 12 and a second side 14 incorporates the grid pattern design 16 of the present invention. The grid design 16 has a white unprinted background 17 and a square pattern of printed (e.g. inked) lines.

In some embodiments no edges are glued, so the grid is decorative and serves the organizational purpose of providing a means for neat labelling of the file. To facilitate this, the squares of the grid pattern are made sufficiently large enough to permit the easy entry of handwritten alphanumeric characters within each square. Typically the squares may be ¼" on a side.

In some embodiments parts of the folders must be glued together. The white space of the grid pattern provides better holding power than completely inked areas that are being glued. Further, this same pattern supplies the decoration and labelling means for the folder.

In a preferred embodiment, as shown in FIG. 1, a glue panel 18 has a glue surface 19 with a portion of the grid pattern 16. The glue panel 18 ends in a fold line 20, and is folded over (in the direction of arrow A) onto the second side 14 of the folder, which also has a grid pattern 16 with an uninked background. Alternatively, the second side may be completely uninked. Due to the uninked fiber-to-fiber contact between the grid patterns of the second side 14 and the glue surface 19, maximum holding power and durability is provided in addition to the decorative effect and the capability for neat labelling, e.g. the "correspondence" legend 23 shown at one edge of the folder of FIG. 1.

FIGS. 2–5 illustrate several possible alternative grid patterns 16*a–d* for folders. These patterns have white uninked backgrounds 17*a–d*, which confer the same useful properties as the square pattern of FIG. 1. FIGS. 2–5 also show the fold lines 20*a–d* between the second sides 14*a–d* and the glue surfaces 19*a–d* of glue panels 18*a–d*. Each grid pattern surface has a substantially white uninked surface area providing the optimal gluing capability, while at the same time providing ample space for lettering that labels the product.

While the present invention has been particularly shown and described with reference to preferred embodiments thereof, it will be understood by those skilled in the art that various changes in form and details may be made therein without departing from the spirit and scope of the invention.

I claim:

1. A folder comprising at least one decorative surface and a regularly repeating geometric pattern printed on said surface, said pattern being formed by a plurality of printed lines which form the elements of the repeating pattern, each element of the pattern having the printed lines surrounding an unprinted area, the unprinted area being of a size adapted to receive legible hand printed characters.

2. A folder as claimed in claim 1 wherein said pattern is made up of squares.

3. A folder as claimed in claim 2 wherein said squares have rounded edges.

4. A folder as claimed in claim 1 wherein said pattern is made up of diamond shapes.

5. A folder as claimed in claim 1 wherein said pattern is made up of hexagons.

6. A folder as claimed in claim 1 wherein said pattern is made up of circles.

7. A folder as claimed in claim 1 wherein the folder is made of paper material, the pattern is printed with ink, at least one part of said folder is glued to at least one other part and at least one of the parts contains the regularly repeating geometric pattern at the location of the glue.

8. A folder as claimed in claim 7 wherein said pattern is made up of squares.

9. A folder as in claim 8 wherein said squares have rounded edges.

10. A folder as claimed in claim 7 wherein said pattern is made up of diamond shapes.

11. A folder as claimed in claim 7 wherein said pattern is made up of hexagons.

12. A folder as claimed in claim 7 wherein said pattern is made up of circles.

* * * * *